US009725204B2

(12) United States Patent
George

(10) Patent No.: US 9,725,204 B2
(45) Date of Patent: Aug. 8, 2017

(54) PAPER-BASED CYLINDRICAL BOTTLE

(71) Applicant: David T. George, Farmington Hills, MI (US)

(72) Inventor: David T. George, Farmington Hills, MI (US)

( * ) Notice: Subject to any disclaimer, the term of this patent is extended or adjusted under 35 U.S.C. 154(b) by 0 days.

(21) Appl. No.: 14/684,362

(22) Filed: Apr. 11, 2015

(65) Prior Publication Data

US 2016/0144993 A1 May 26, 2016

Related U.S. Application Data

(60) Provisional application No. 62/082,218, filed on Nov. 20, 2014.

(51) Int. Cl.

| | |
|---|---|
| ***B65D 3/04*** | (2006.01) |
| ***B65D 21/08*** | (2006.01) |
| ***B65D 41/32*** | (2006.01) |
| ***B65D 6/00*** | (2006.01) |
| ***B65D 41/04*** | (2006.01) |
| ***B65D 3/20*** | (2006.01) |
| ***B65D 8/00*** | (2006.01) |
| ***B65D 25/42*** | (2006.01) |

(52) U.S. Cl.
CPC ..... *B65D 3/20* (2013.01); *B65D 15/08* (2013.01); *B65D 25/42* (2013.01)

(58) Field of Classification Search
CPC ..... B65D 3/04; B65D 21/086; B65D 41/325; B65D 41/04; B65D 13/04; B65D 5/746
USPC ..... 229/5.5
See application file for complete search history.

(56) References Cited

U.S. PATENT DOCUMENTS

| | | | | |
|---|---|---|---|---|
| 2,058,592 | A * | 10/1936 | Albert Karlsson-Ygger | B65D 3/20 229/125.08 |
| 3,430,805 | A | 3/1969 | Buchner et al. | |
| 3,826,409 | A * | 7/1974 | Chilcoate | B65D 77/283 222/107 |
| 4,014,723 | A | 3/1977 | Jones | |
| 4,190,188 | A | 2/1980 | Ohmori | |
| 4,356,926 | A | 11/1982 | Priestly et al. | |
| 4,564,139 | A * | 1/1986 | Reil | B65D 3/02 222/530 |
| 5,248,054 | A * | 9/1993 | Berggren | B65D 5/746 215/226 |
| 5,439,124 | A | 8/1995 | Mock | |

(Continued)

FOREIGN PATENT DOCUMENTS

| | | | | |
|---|---|---|---|---|
| EP | 0345174 | A1 | 12/1989 | |
| EP | 17905730 | A1 * | 11/2005 | B65D 5/0005 |

(Continued)

*Primary Examiner* — Christopher Demeree
(74) *Attorney, Agent, or Firm* — Vincent Re PLLC

(57) ABSTRACT

A bottle package is disclosed for providing consumer packaging for liquid products. The package includes a paper-based cylindrical main body section providing a circular footprint for the package. In one embodiment, the package includes a paper conical section attached to the main body section. In one embodiment, the package includes a plastic bottle top comprising a screw on cap fitted to and adhered to an inside of the paper conical section to provide a screw on bottle top section on a top of the package. In one embodiment, the main body section includes annular creases configured to enable a collapsed state wherein the main body section includes accordion-style folds.

8 Claims, 12 Drawing Sheets

(56) References Cited

U.S. PATENT DOCUMENTS

| | | | | |
|---|---|---|---|---|
| 5,636,771 | A * | 6/1997 | Gordon | B65D 5/746 220/270 |
| 5,968,616 | A | 10/1999 | Kakemura et al. | |
| 7,726,551 | B2 * | 6/2010 | Abbott | B65D 3/06 229/138 |
| 8,540,094 | B2 * | 9/2013 | Riedl | B29B 11/06 215/13.1 |
| 2004/0069740 | A1 * | 4/2004 | Athalye | B65D 1/0292 215/381 |
| 2007/0102434 | A1 | 5/2007 | Dunwoody et al. | |
| 2010/0084361 | A1 * | 4/2010 | Dayton | B31B 43/00 215/40 |
| 2010/0108746 | A1 * | 5/2010 | Sponholtz | B65D 3/20 229/4.5 |

FOREIGN PATENT DOCUMENTS

| | | | | |
|---|---|---|---|---|
| EP | 1616800 | A2 * | 1/2006 | B65D 5/746 |
| WO | WO-2010/085182 | * | 1/2009 | B65D 3/04 |
| WO | WO-2015/031964 | A1 * | 9/2013 | B65D 3/04 |

* cited by examiner

PAPER-BASED CYLINDRICAL BOTTLE

CROSS REFERENCE TO RELATED APPLICATIONS

This disclosure claims the benefit of U.S. Provisional Application No. 62/082,218 filed on Nov. 20, 2014 which is hereby incorporated by reference.

TECHNICAL FIELD

This disclosure is related to an object for use in packaging a liquid product. In particular, the disclosure is related to a partially or fully biodegradable paper bottle for providing a liquid product to consumers.

BACKGROUND

The statements in this section merely provide background information related to the present disclosure. Accordingly, such statements are not intended to constitute an admission of prior art.

Consumers demand portable drink containers that are disposable. Plastic bottles in a single serving size are popular because they are convenient. A consumer can buy an exemplary twelve pack of soda or drinking water at a store, put the pack in a refrigerator, and take out individual bottles on demand.

Plastic bottles are problematic environmentally. Plastic does not biodegrade in a reasonable amount of time. Landfills and bodies of water (e.g. oceans) in which garbage is dumped have large amounts of plastic bottles which persist as a growing problem. Environmentalism as a cause is popular with the public, and consumers demand and respond to environmentally responsible packaging.

SUMMARY

A bottle package is disclosed for providing consumer packaging for liquid products. The package includes a paper-based cylindrical main body section providing a circular footprint for the package. In one embodiment, the package includes a paper conical section attached to the main body section. In one embodiment, the package includes a plastic bottle top comprising a screw on cap fitted to and adhered to an inside of the paper conical section to provide a screw on bottle top section on a top of the package. In one embodiment, the main body section includes annular creases configured to enable a collapsed state wherein the main body section includes accordion-style folds.

BRIEF DESCRIPTION OF THE DRAWINGS

One or more embodiments will now be described, by way of example, with reference to the accompanying drawings, in which:

FIG. 7A illustrates an empty, initially collapsed bottle waiting to be filled;

FIG. 7B illustrates the bottle of FIG. 7A expanding as it is being filled with water; and FIG. 7C illustrate the bottle of FIGS. 7A and 7B being collapsed after use;

FIG. 8A illustrates a filled bottle including the spiral twist pattern and a tear away plastic cap;

FIG. 8B illustrates the bottle of FIG. 8B with the cap torn away and the bottle in a twisted, collapsed state; and FIG. 8C illustrates the tear away plastic cap of FIG. 8C in detail;

FIG. 12 illustrates a piece of paper stock cut into a shape for constructing cylindrical bottle;

FIG. 13 illustrates the piece of paper stock of FIG. 12 including designations to various areas of the shape;

FIG. 14 illustrates the paper stock being rolled into a cylindrical shape and bottom lobes being folded over to create a bottle bottom;

FIG. 15 illustrates the cylindrical body formed into shape, the bottle bottom sealed, and an end cap ready for installation to the bottle bottom;

FIG. 16 illustrates the cylindrical body ready to form a folded carton top;

FIG. 17 illustrates the formation of four corners in the top of the bottle; and FIG. 18 illustrate the four corners of the top of the bottle sealed in pairs to create the folded carton top to the cylindrical bottle.

DETAILED DESCRIPTION

Plastic bottles do not degrade quickly. Consumer demand exists for biodegradable packaging. Paper readily degrades.

Cylindrical plastic bottles are very popular. Consumer products, such as motor vehicles, bicycles, movie theater seats, etc., are configured with such devices as cup holders configured to hold cylindrical drink containers. However, known paper liquid containers tend to have square footprints. For example, known milk-cartons include square footprints, rectangular-shaped side walls, and triangular-shape prism tops. Such milk-cartons do not conveniently fit in cup holders and are consequentially impractical for use in situations including a cup holder.

A cylindrically-shaped water bottle constructed partially or fully of a paper product with a circular footprint is disclosed.

Figure 1:
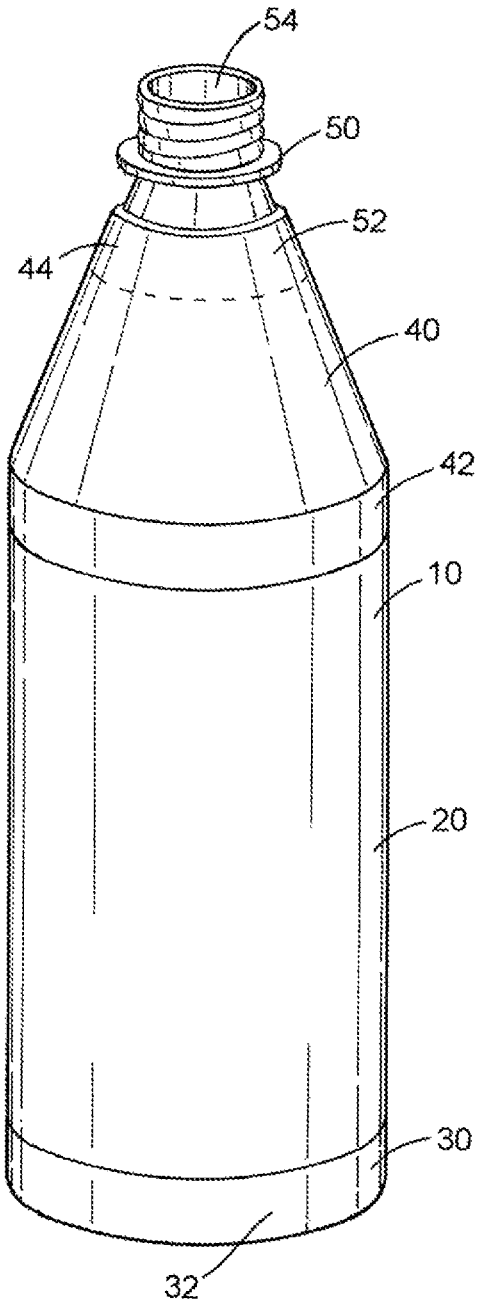
FIG. 1 illustrates an exemplary embodiment of a partially paper bottle with a cylindrical main body section and with an exemplary plastic threaded bottle cap section, in accordance with the present disclosure.

FIG. 1 illustrates an exemplary embodiment of a partially paper bottle with a cylindrical main body section and with an exemplary plastic threaded bottle cap section. Bottle 10 includes cylindrical main body section 20 constructed of paper, paper base section 30, conical paper top section 40, and plastic threaded bottle cap section 50. Main body section 20 is joined to base section 30 in junction area 32 with glue or other known joining methods. Main body section 20 is joined to top section 40 in junction area 42 with glue or other known joining methods. Top section 40 is joined to conical junction section 52 of bottle cap section 50 in junction area 44 with glue or other known joining methods. Bottle cap section 50 includes threaded opening 54 which can be conveniently reclosed by a consumer with a bottle cap.

Figure 2:
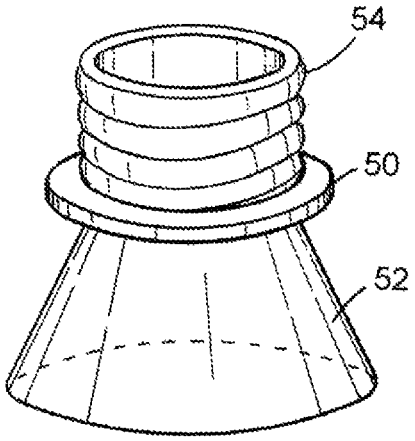
FIG. 2 illustrates in cross-section the threaded bottle cap section of FIG. 1, in accordance with the present disclosure.

FIG. 2 illustrates in cross-section the threaded bottle cap section of FIG. 1. Threaded bottle cap section 50 includes conical junction section 52 and threaded opening 54. Bottle cap section 50 is convenient as it is easily reclosed by the consumer and is a familiar opening from which a consumer can drink. However, the plastic content of bottle 10 as compared to a standard plastic bottle is greatly reduced.

Figure 3:
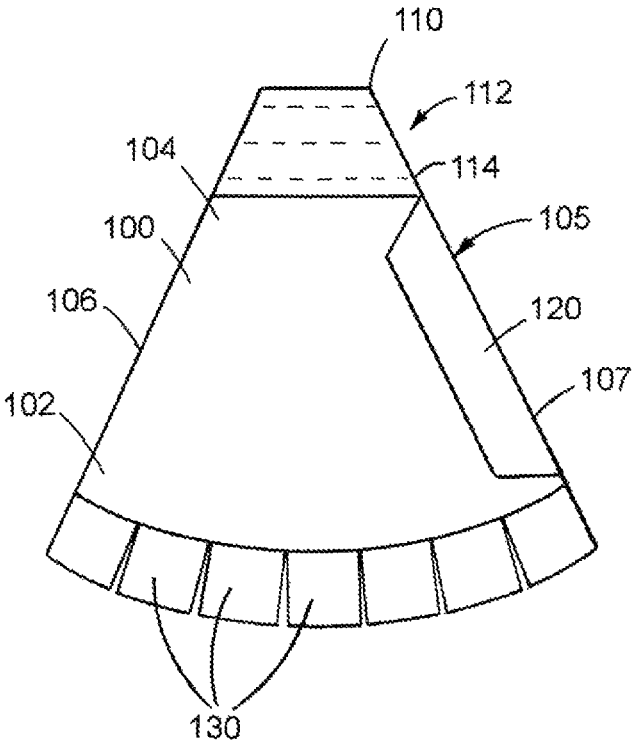
FIG. 3 illustrates an exemplary paper cone top section, in accordance with the present disclosure.

FIG. 3 illustrates an exemplary paper cone top section. Paper cone top section 100 is provided as a substitute or alternative to top section 40 of bottle 10. Paper cone top section 100 comprises a first sheet 104 of paper and a second sheet 105 which are joined along a first side 106 and a second side 107. Sheets 104 and 105 include curved bottom portions 102 which, when the sheets are separated and pulled apart, form a circular opening along tabs 130 to join with a cylindrical main body section. Exemplary paper tab 120 is illustrated joining sheets 104 and 105 along side 107. Section 100 further includes tab 110 along the top of section 100 which is provided for easy opening of the section and the bottle formed by section 100. Tab 110 includes glue pattern 112 closing the tab 110 and perforated line 114 permitting a consumer to tear off tab 110 to open the bottle. Tabs 130 are provided for joining section 100 to a cylindrical main body section to form the bottle.

Figure 4:
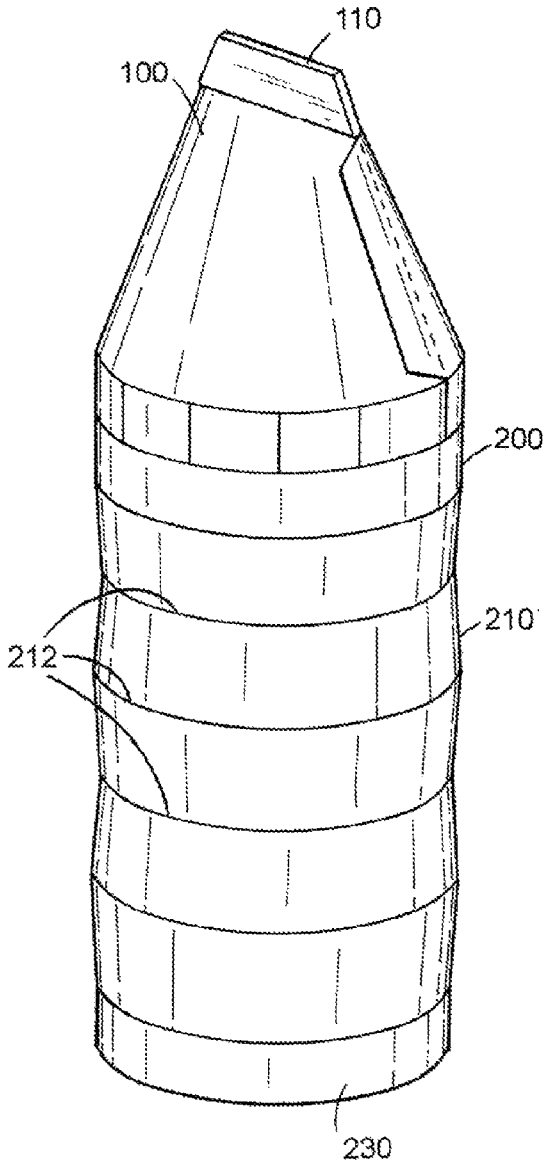
FIG. 4 illustrates an exemplary embodiment of a fully paper bottle with a cylindrical main body section including the paper cone top section of FIG. 3 and a collapsible accordion-style main body section, in accordance with the present disclosure.

FIG. 4 illustrates an exemplary embodiment of a fully paper bottle with a cylindrical main body section including the paper cone top section of FIG. 3 and a collapsible accordion-style main body section. Bottle 200 illustrates paper cone top section 100 including tab 110 adjoined to cylindrical main body section 210. Main body section 210 includes accordion-style creases 212 configured to facilitate collapsing of main body section 210 when the consumer is ready to dispose of the empty bottle. Bottle 200 includes cap section 230 attached to main body section 210. Cap section 230 can include non-limiting examples of tabs similar to the tabs 110 of top section 100, a pressed paper cup, a cylindrical outer section adhered to a bottom plate, or a molded plastic cup. In one embodiment, the side walls of the main body section 210 formed into a cylinder can be sealed with a flat plate on the bottom adhered to the interior of the cylinder, such as is commonly performed in a paper cup.

Figure 5:
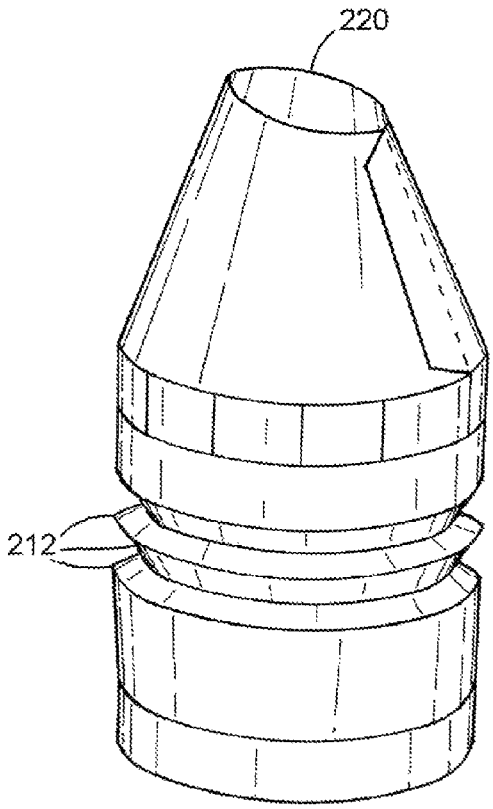
FIG. 5 illustrates the paper bottle of FIG. 4 with the accordian-style main body section collapsed for disposal, in accordance with the present disclosure.

FIG. 5 illustrates the paper bottle of FIG. 4 with the accordion-style main body section collapsed for disposal. The bottle is illustrated with the tab 110 of FIG. 4 removed, thereby exposing hole 220 from which the consumer can drink. Creases 212 are illustrated with the bottle in a collapsed state.

Figure 6:
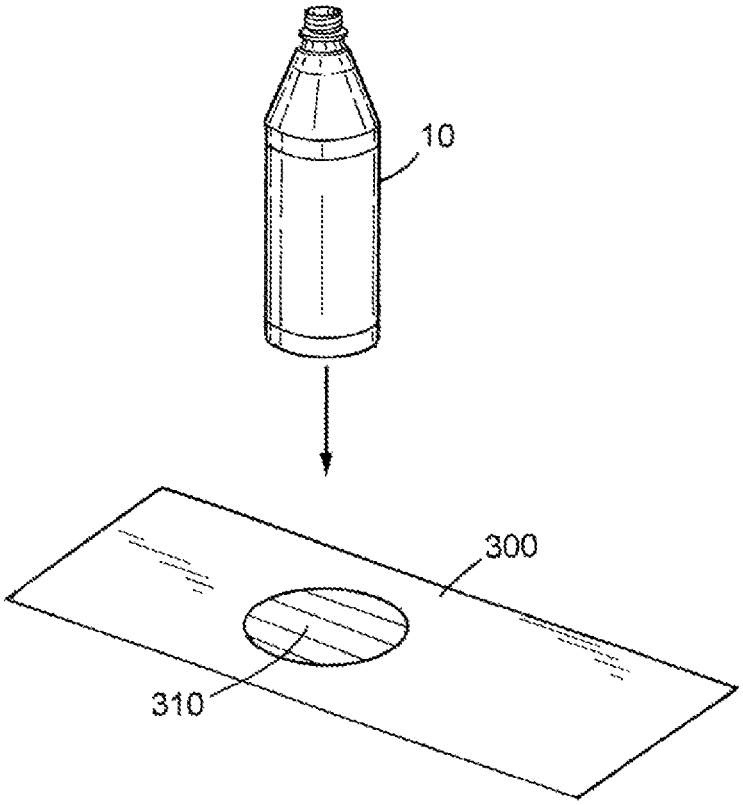
FIG. 6 illustrates the paper bottle of FIG. 1 being placed within a cylindrically shaped cup holder in a motor vehicle, in accordance with the present disclosure.

FIG. 6 illustrates the paper bottle of FIG. 1 being placed within a cylindrically shaped cup holder in a motor vehicle. Motor vehicle surface 300 includes cup holder 310 configured to hold a cylindrical container. Paper bottle 10 is illustrated being placed into cup holder 310 for the convenience of the consumer.

Figure 11:
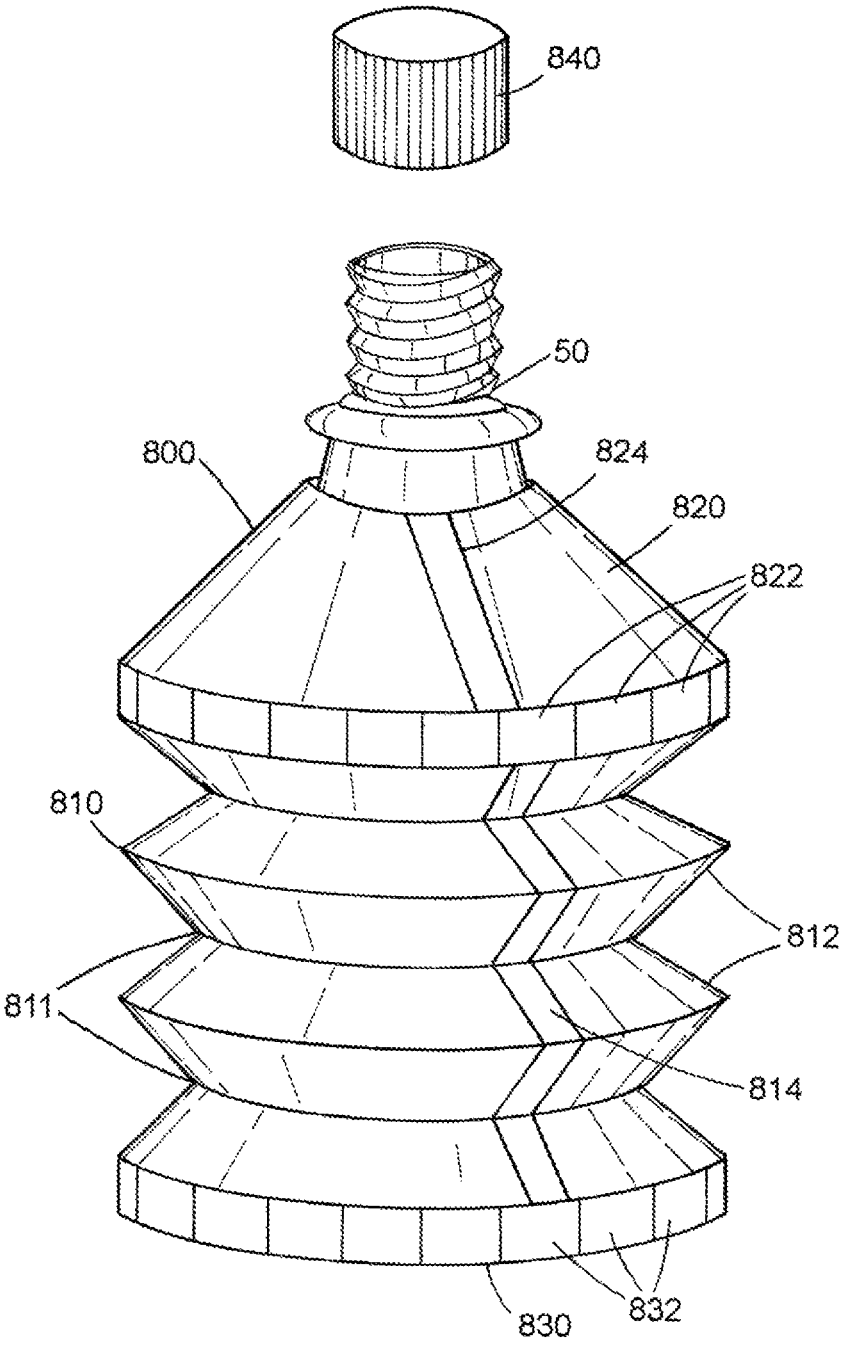
FIG. 11 illustrates another exemplary embodiment of a paper bottle with a cylindrical main body section including a collapsible accordian-style main body section, in accordance with the present disclosure.

FIG. 11 illustrates another exemplary embodiment of a paper bottle with a cylindrical main body section including a collapsible accordion-style main body section. Paper bottle 800 is illustrated in a partially collapsed state including main body section 810, conical section 820, bottle cap section 50, end cap 830, and bottle cap 840. Main body section 810, when filled with water, forms a cylindrical main body of the bottle. Main body section 810 is formed from a flat piece of paper stock joined along seam 814 to form the cylindrical shape. Main body section 810 includes pre-formed creases 812 causing the main body section 810 to fold inward along creases 812 and pre-formed creases 811 causing the main body section 810 to fold outward along creases 811. End cap 830 includes exemplary tabs 832 adhering end cap 830 to main body section 810. Conical section 820 is illustrated including tabs 822 adhering conical section 820 to main body section 810 and seam 824. Bottle cap section 50 is attached to conical section 820 and permits attachment of bottle cap 840 to seal paper bottle 800.

Figure 7A:
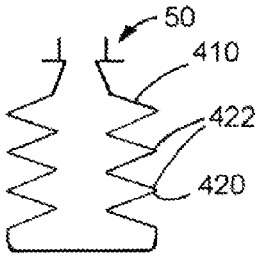
FIGS. 7A-7C illustrate various stages of use for an exemplary collapsible paper bottle, in accordance with the present disclosure.
Figure 7B:
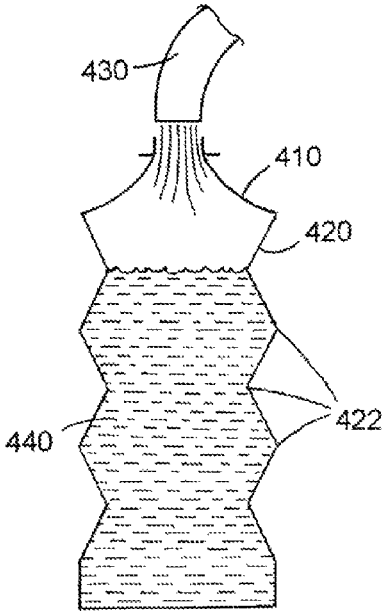
Figure 7C:
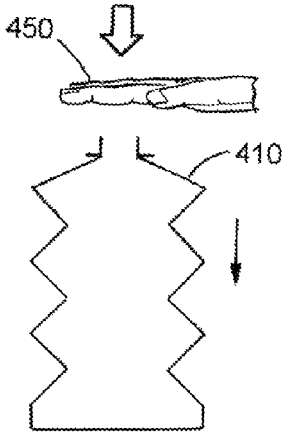

FIGS. 7A-7C illustrate various stages of use for an exemplary collapsible paper bottle, illustrated in section. FIG. 7A illustrates an empty, initially collapsed bottle waiting to be filled. Water bottle 410 includes paper body 420 and bottle cap section 50. Paper body 420 includes accordion-style features 422 permitting the bottle to selectively collapse or extend into a filled state. FIG. 7B illustrates the bottle of FIG. 7A expanding as it is being filled with water. Bottle 410 is illustrated including paper body 420 extended into a filled state. Water 440 is illustrated filling paper body 420 through water feed tube 430. It will be appreciated that any liquid that can be contained within a paper container can be substituted for water 440. The presence of water 440 applies pressure to the inside of body 420, causing features 422 to straighten. FIG. 7C illustrate the bottle of FIGS. 7A and 7B being collapsed after use. Hand 450 is illustrated applying a downward force on bottle 410, emptied of water after use. Hand 450 can easily return bottle 410 from an expanded state corresponding to when the bottle was filled with water to a collapsed state.

Figure 8A:
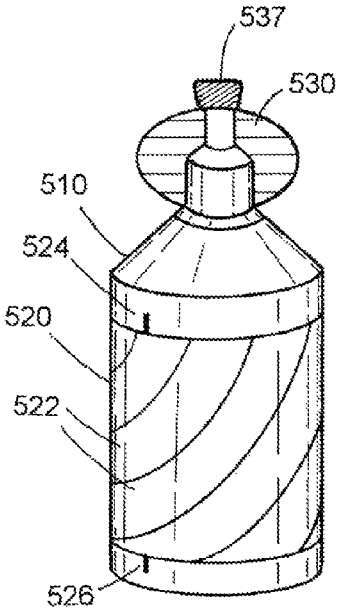
FIGS. 8A-8C illustrate use of an exemplary collapsible paper bottle including a spiral twist pattern in the bottle, in accordance with the present disclosure.
Figure 8B:
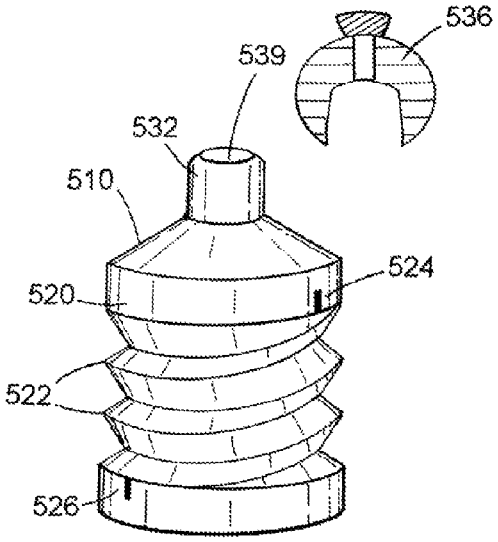
Figure 8C:
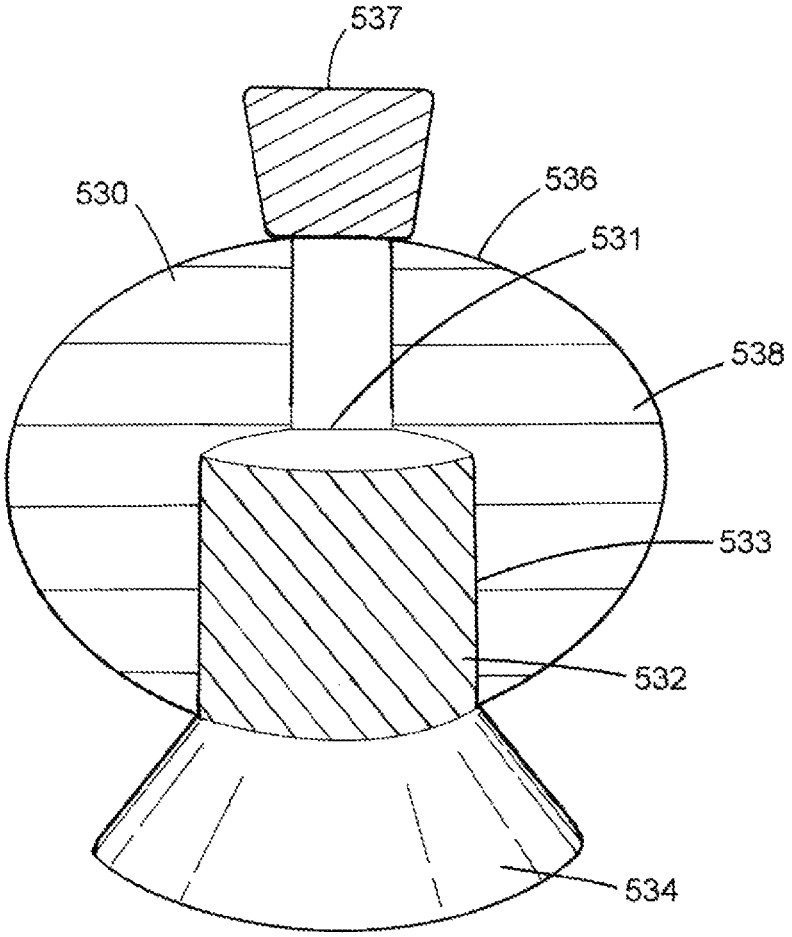

FIGS. 8A-8C illustrate use of an exemplary collapsible paper bottle including a spiral twist pattern in the bottle. FIG. 8A illustrates a filled bottle including the spiral twist pattern and a tear away plastic cap. Paper bottle 510 is illustrated including paper body section 520 and tear away plastic cap 530. Paper body section 520 is illustrated including spiral twist pattern creases 522 extending along the cylindrical body of section 520. The creases make it likely that if the container is twisted along the body section 520, the body section 520 will collapse at the creases and crush in a twisted state. Tear away plastic cap 530 can include any feature that can initially seal the bottle and subsequently be broken away from the bottle to permit one to drink or pour from the bottle. One exemplary tear away feature is exemplified by KOOL AID BURSTS® bottles. Such bottles are blow molded according to methods known in the art, provide an initially open filling hole, and permit a manufacturer to seal the filling hole. Such a process can be used to make plastic cap 530, additionally including a mechanical cutting step to create an open conically-shaped section similar to feature 52 of bottle cap section 50 of FIG. 2. Plastic cap 530 includes feature 537 which is initially an open filling hole for a manufacturers to be able to fill bottle 510 and which can later be sealed, for example, through application of heat to melt the feature into a closed or sealed state. Exemplary locations 524 and 526 are illustrated, showing alignment of a top of body section 520 and a bottom of body section 520 when the bottle 510 is in an extended or filled state. FIG. 8B illustrates the bottle of FIG. 8B with the cap torn away and the bottle in a twisted, collapsed state. Bottle 510 is illustrated after being emptied, with tear away cap 536 removed and with body section 520 twisted and in a collapsed state. Exemplary locations 524 and 526 are illustrated, where location 524 has twisted along with the rest of the top of the bottle, such that locations 526 and 524 are no longer aligned upon the bottle. Creases 522 are illustrated, each having folded and facilitated the bottle crushing according to a rotary twist movement defined by the creases 522. With tear away cap 536 removed, open drinking hole 539 of mouthpiece 532 is exposed to permit a person to drink or pour liquid from bottle 510. FIG. 8C illustrates the tear away plastic cap of FIG. 8C in detail. Bottle cap section 530 is illustrated including mouthpiece 532, tear away cap 536, conical attachment section 534, and feature 537 permitting filling through the section 530 and subsequent sealing of the bottle. Mouthpiece 532 is connected to tear away plastic cap at creased attachment 531, wherein the plastic is weakened by a sharp bend in the plastic, such that a person applying a twisting force to handle sections 538 create a tear in the plastic at creased attachment 531, thereby exposing the drinking hole 539 of FIG. 8B. Handle section 538 can be similarly initially attached to mouthpiece 532 along seam 533 with thin plastic or spot connections, creating stability in the part prior to opening while permitting a person to easily open the bottle with a twisting force. Conical section 534 is configured to be adhered to a top of a paper bottle with adhesives known in the art approved for use with food products. Bottle cap section 530 is provided as an exemplary bottle top. It will be appreciated that a number of different bottle cap section configurations can be used with the paper bottle of the present disclosure, and the disclosure is not intended to be limited to the particular examples provided herein.

Figure 9:
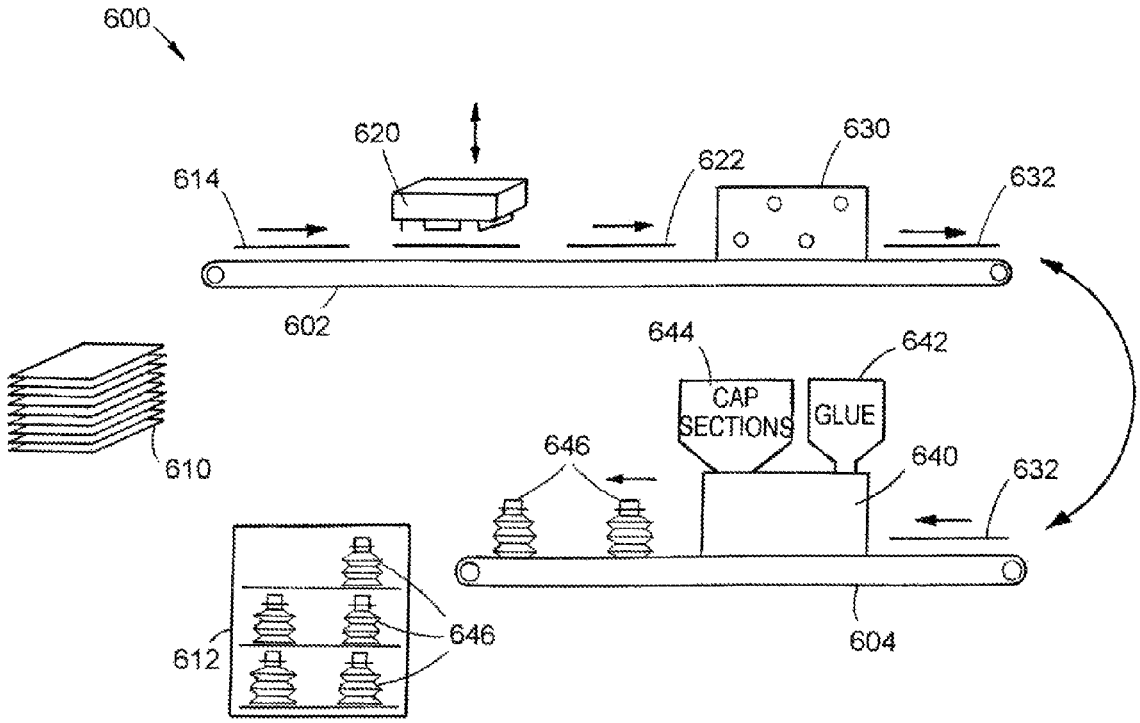
FIG. 9 illustrates an exemplary manufacturing process to create empty, collapsed bottles ready to fill, in accordance with the present disclosure.

FIG. 9 illustrates an exemplary manufacturing process to create empty, collapsed bottles ready to fill. Process 600 including assembly conveyors 602 and 604 is provided to generically illustrate a mechanized, automated process for creating paper bottles according to the disclosure. In all instances of process 600, the particular machinery is not intended to be representative of the actual machinery used, and the disclosure is intended to include machinery and automated mechanical devices known in the art for manipulating paper products and manufacturing paper based food containers. Paper stock supply 610 is illustrated, including flat pieces of paper product stock for use in making paper bottles. In one embodiment, the paper product stock can include paperboard covered on each side with polyethylene as is commonly known to be used with refrigerated products. In another embodiment, the paper product stock can include three layers of polyethylene with paperboard between a first and second layers of the polyethylene and with a thin layer of aluminum between the second and third layers of the polyethylene as is known to be used with shelf-stable products. Other paper products known in the art can similarly be used. Individual units 614 of paper product stock are placed upon conveyor 602. Station 620 can stamp the units 614 to create units 622 with a particular desired outline. Station 630 can bend and/or crease units 622 to create creased units 632. Units 632 are placed upon exemplary conveyor 604, and station 640 can shape, bind with adhesive, and connect units 632 with glue from hopper 642 and cap section from hopper 644 to create formed bottle units 646 which can be placed in bottle unit packaging 612.

Figure 10:
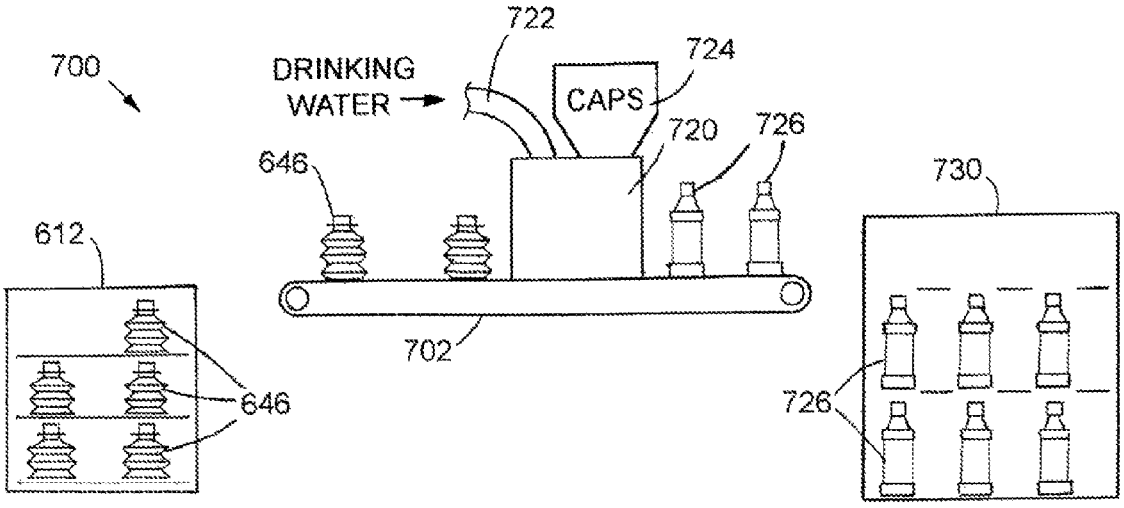
FIG. 10 illustrates an exemplary manufacturing process to fill initially empty, collapsed bottles, in accordance with the present disclosure.

FIG. 10 illustrates an exemplary manufacturing process to fill initially empty, collapsed bottle units to create consumer ready liquid products. Process 700 including assembly conveyor 702 is provided to generically illustrate a mechanized, automated process for expanding and filling paper bottles according to the disclosure. In all instances of process 700, the particular machinery is not intended to be representative of the actual machinery used, and the disclosure is intended to include machinery and automated mechanical devices known in the art for manipulating paper products and manufacturing paper based food containers. Bottle unit packaging 612 is illustrated including bottle units 646 ready to be filled with liquid. The exemplary bottle units 646 are illustrate in a collapsed state ready to be filled with liquid, as is illustrated in FIG. 7A. However, it will be appreciated that pre-formed, non collapsible bottles, for example, as illustrated in FIG. 1, could similarly be used. Station 720 can receive bottle units 646, fixture the units to be filled by drinking water supply 722 and to be capped with caps from hopper 724. Resulting filled bottles 726 are created and placed in product packaging 730 for shipment to retail stores. The processes of FIGS. 9 and 10 are provided as examples of how paper bottles disclosed herein can be created and filled. Many different manufacturing processes are envisioned according to methods known in the art, and the disclosure is not intended to be limited to the particular examples provided herein.

Figure 12:
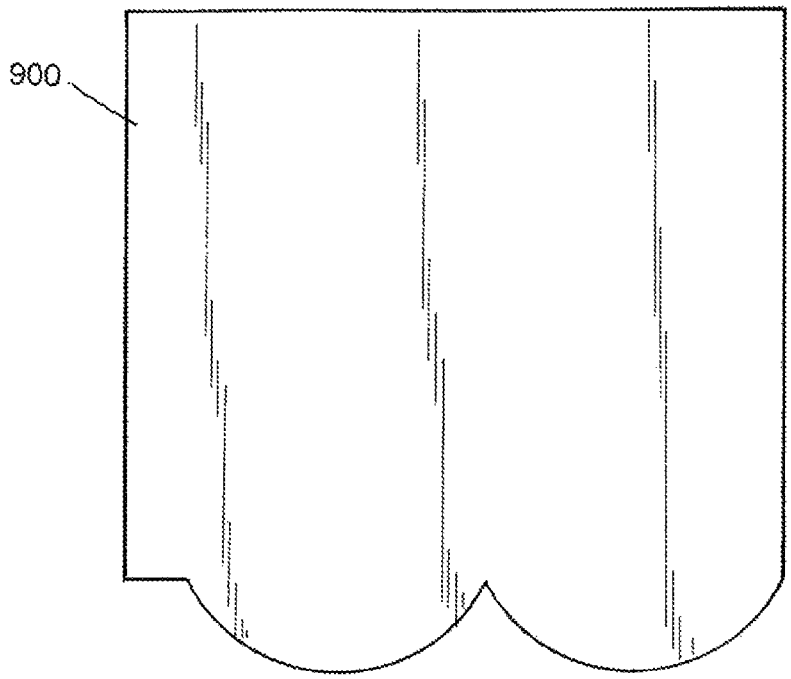
FIGS. 12-18 illustrate an exemplary process to create a cylindrical bottle from a flat piece of paper stock, in accordance with the present disclosure.

FIGS. 12-18 illustrate an exemplary process to create a cylindrical bottle from a flat piece of paper stock. FIG. 12 illustrates a piece of paper stock cut into a shape for constructing cylindrical bottle. Paper stock 900 can be cut from exemplary polyethylene coated paper stock. Such stock can be cut, for example, with multiple pieces being cut at once from a large sheet. The cutting is typically aligned with a print pattern on the sheet so that advertising and package imaging is correctly positioned on the resulting bottle.

Figure 13:
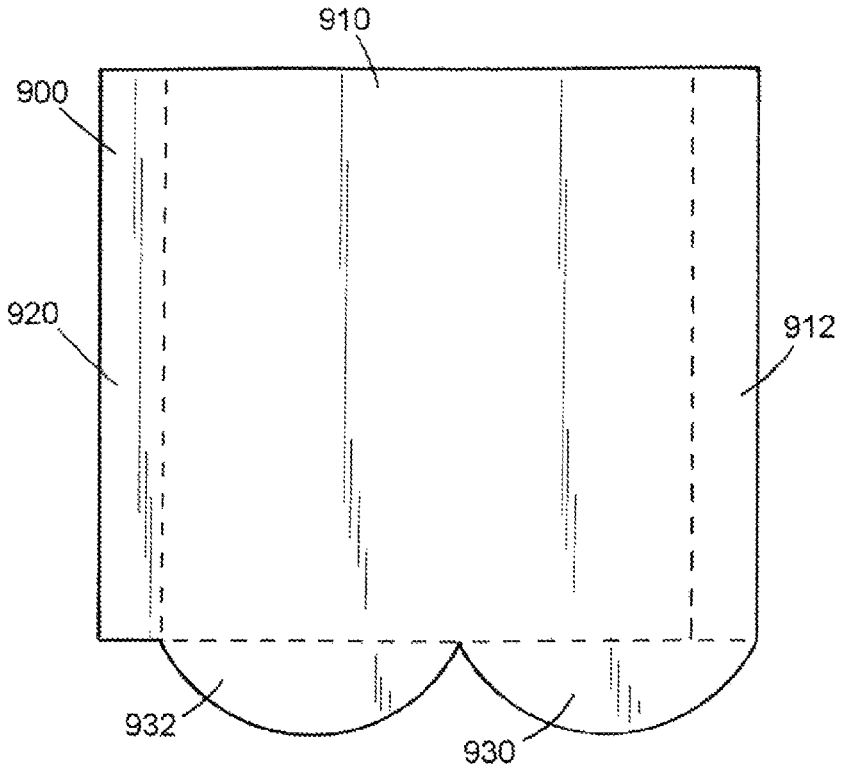

FIG. 13 illustrates the piece of paper stock of FIG. 12 including designations to various areas of the shape. Paper stock 900 includes body section 910 which will be rolled into a cylindrical form to create the cylindrical body of the bottle. Tab section 920 will be adhered to tab receiving area 912 to form the cylindrical body. Lobes 930 and 932 will be folded over on each other and adhered to each other to create a sealed bottle bottom, such that a liquid can be stored within the cylindrical body without leakage.

Figure 14:
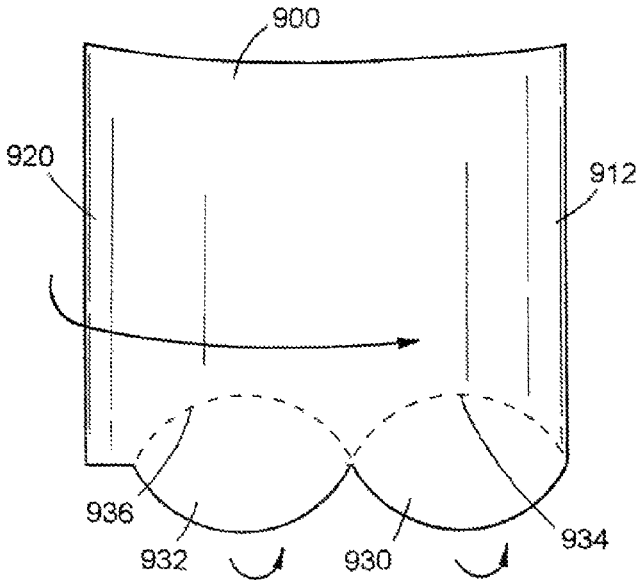

FIG. 14 illustrates the paper stock being rolled into a cylindrical shape and bottom lobes being folded over to create a bottle bottom. Paper stock 900 is illustrated with tab section 920 being rolled toward the viewer such that it will be positioned and adhered to tab receiving area 912. Arcs 934 and 936 are illustrated, showing where folds are pre-formed or created as lobes 930 and 932 are folded over on each other.

Figure 15:
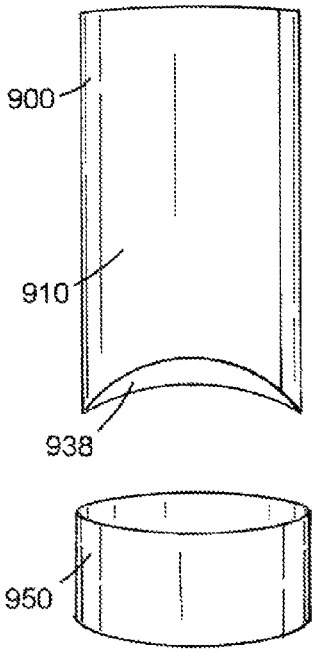

FIG. 15 illustrates the cylindrical body formed into shape, the bottle bottom sealed, and an end cap ready for installation to the bottle bottom. Paper stock 900 is illustrated with body section 910 formed into a cylindrical body. Bottle bottom 938 is illustrated created as an arcuate or concave enclosure. Such an arcuate enclosure would not stand up on its own. An exemplary end cap 950 is illustrated ready to be slid over bottle bottom 938 and adhered to the sides of body section 910 to create a flat bottom to the bottle.

Figure 16:
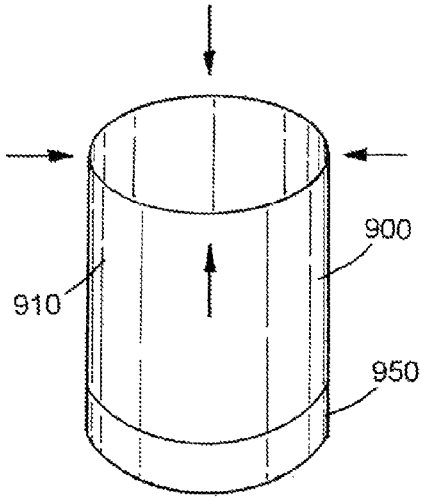

FIG. 16 illustrates the cylindrical body ready to form a folded carton top. Paper stock 900 including body section 910 is illustrated with end cap 950 installed thereto. According to one exemplary operation, the container can be filled with the liquid product to be sold at this point. The top of body section 910 can be fixtured and pressure applied at the points of the four illustrated arrows to fold the top of the bottle inward in preparation for sealing the top of the bottle.

Figure 17:
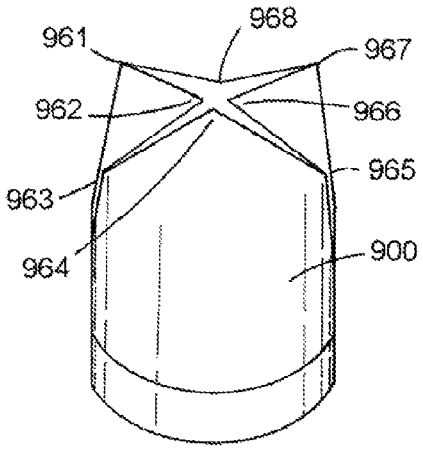

FIG. 17 illustrates the formation of four corners in the top of the bottle. The pressures applied to paper stock 900 in FIG. 16 have resulted in four depressions 962, 964, 966, and 968 being formed in the top of the bottle, along with four corresponding corners 961, 963, 965, and 967.

Figure 18:
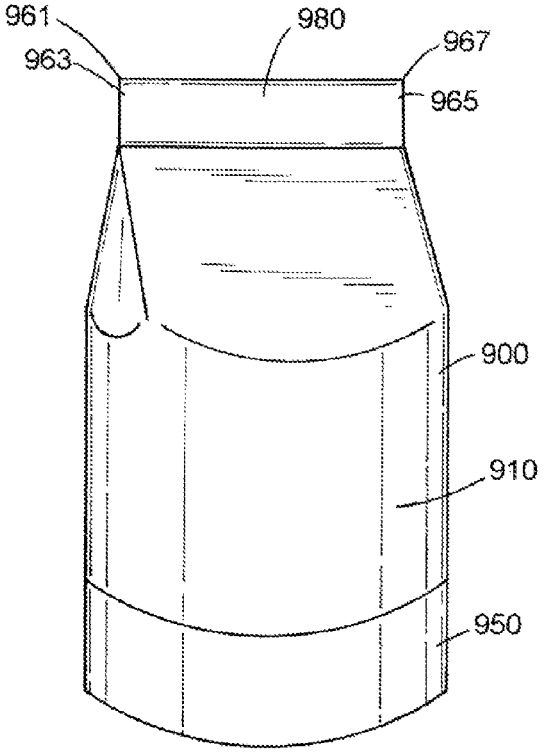

FIG. 18 illustrate the four corners of the top of the bottle sealed in pairs to create the folded milk-carton-style top to the cylindrical bottle. Paper stock 900 is illustrated including body section 910 formed into a cylindrical body, end cap 950 providing a stable bottom to the bottle, and with corners 961 and 963 sealed together and with corners 965 and 967 sealed together, the sealed corners collectively formed sealed milk-carton-style top 980. The process to form a cylindrical bottle from flat paper stock is exemplary, a number of such processes are envisioned, and the disclosure is not intended to be limited to the particular examples provided herein.

Paper bottles disclosed herein are constructed of paper or cardboard products known in the art for use with food products. Coatings to prevent the liquid from soaking through the paper known in the art can be utilized. In another embodiment, a liner, for example, constructed of known Mylar material could be used to line the inside of the paper bottle. Joining methods between two paper products, such as glue used in known milk-cartons, can be used to join various paper sections of the bottle. Joining methods between a paper product and a plastic product can be used to join a paper section of the bottle to a plastic section of the bottle. Mechanical devices for folding, creasing, perforating, or otherwise manipulating paper or cardboard containers can be used in the construction of the disclosed paper bottles.

A number of paper product can be used with the included disclosure. For example, milk cartons are known to be used to paper stock coated on both sides with polyethylene or other polymers. New biodegradable coatings such as a corn-based plastic are known in the art for coating paper products to make them waterproof and therefore a viable liquid container. A Mylar or similar bag within a paper outer package could allow plain paper without plastic coatings to be used for the outer packaging of a liquid container. A number of materials, shapes, sizes, coatings, linings, layered packaging and other options are envisioned for the disclosed container, and the disclosure is not intended to be limited to the examples provided herein.

The exemplary paper containers disclosed herein can be made from a plurality of paper cut-outs. In one exemplary embodiment, a single paper cutout can be generated with all or a majority of the paper features of the container and then put through a folding and sealing process to construct the three-dimensional shape of the container from the single paper cutout.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A bottle package for providing consumer packaging for liquid products, the package comprising:

a paper-based cylindrical main body section providing a circular footprint for the package; and a paper cone top section comprising a conical base section, wherein the conical base section is adhered to a top portion of the main body section;

wherein the main body section includes a series of annular creases along the main body section configured to enable two states comprising:

a collapsed state wherein the main body section includes accordion-style folds; and a filled state wherein the main body section forms a cylindrical shape.

2. The bottle package of claim 1, wherein the paper cone top section further comprises a tear away cap.

3. A bottle package for providing consumer packaging for liquid products, the package comprising:

a paper-based cylindrical main body section providing a circular footprint for the package;

a paper conical section attached to the main body section; and a plastic bottle top comprising a screw on cap fitted to and adhered to an inside of the paper conical section to provide a screw on bottle top section on a top of the package;

wherein the main body section includes annular creases configured to enable a collapsed state wherein the main body section includes accordion-style folds.

4. The bottle package of claim 3, further comprising a paper conical section attached to the main body section and comprising a plastic bottle top comprising a tear away cap.

5. The bottle package of claim 1, wherein the annular creases enabling the collapsed state enable the bottle packed to be shipped in the collapsed state for subsequent filling with a liquid.

6. The bottle package of claim 1, further comprising a cylindrical paper cap section adhered to a bottom of the main body section.

7. The bottle package of claim 1, wherein the main body section comprises a concave enclosure on a bottom of the body section; and further comprising a cylindrical paper cap section adhered to a bottom of the main body section covering the concave enclosure.

8. The bottle package of claim 3, further comprising a paper conical section attached to the main body section and comprising a plastic bottle top comprising a screw on cap.

* * * * *